US007083389B2

(12) United States Patent
Blangetti et al.

(10) Patent No.: US 7,083,389 B2
(45) **Date of Patent: *Aug. 1, 2006**

(54) COMPRESSOR FOR GAS TURBINES

(75) Inventors: Francisco Blangetti, Baden (CH); Harald Reiss, Heidelberg (DE)

(73) Assignee: ALSTOM Technology Ltd., Baden (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/847,473

(22) Filed: May 18, 2004

(65) Prior Publication Data

US 2004/0213675 A1 Oct. 28, 2004

Related U.S. Application Data

(63) Continuation of application No. PCT/IB02/04745, filed on Nov. 12, 2002.

(30) Foreign Application Priority Data

Nov. 19, 2001 (CH) ..... 2001 2125/01

(51) Int. Cl.
*F01D 5/14* (2006.01)

(52) U.S. Cl. ..... 416/241 R; 428/408

(58) Field of Classification Search ..... 415/200
See application file for complete search history.

(56) References Cited

U.S. PATENT DOCUMENTS

| | | | | |
|---|---|---|---|---|
| 2,899,943 | A | 8/1959 | Haensel et al. | |
| 4,695,229 | A | 9/1987 | Feuling | |
| 5,463,873 | A | 11/1995 | Early et al. | |
| 5,707,717 | A * | 1/1998 | Shibahara et al. | 428/217 |
| 6,099,976 | A * | 8/2000 | Lemelson et al. | 428/623 |
| 6,623,241 | B1 * | 9/2003 | Blangetti et al. | 415/200 |
| 6,780,509 | B1 * | 8/2004 | Reiss et al. | 428/408 |

FOREIGN PATENT DOCUMENTS

| | | | |
|---|---|---|---|
| DE | 196 25 329 | A1 | 1/1998 |
| EP | 0 589 641 | A2 | 3/1994 |
| EP | 0 468 024 | B1 | 10/1994 |
| SU | 572576 | | 9/1977 |
| SU | 1507991 | A1 | 9/1989 |
| WO | 99/43865 | | 9/1999 |
| WO | 00/75394 | | 12/2000 |
| WO | 02/40934 | A1 | 5/2002 |
| WO | 03/044374 | A1 | 5/2003 |

OTHER PUBLICATIONS

Search Report from PCT/IB 02/04745 (Feb. 13, 2003).
Search Report from CH 21252001 (Mar. 27, 2002).
IPER from PCT/IB02/04745 (Jul. 7, 2003).
Ratner, Buddy D, "Plasma Deposition of Organic thin Films-control of Film Chemistry", XP 000645982 (Mar. 12, 1997).

* cited by examiner

*Primary Examiner*—Edward K. Look
*Assistant Examiner*—Nathan Wiehe
(74) *Attorney, Agent, or Firm*—Cermak & Kenealy, LLP; Adam J. Cermak

(57) ABSTRACT

A compressor for a gas turbine has, on the surfaces of its components, in particular of its blading, a coating for protecting the surfaces from erosion. The coating has at least two layers or a plurality of pairs of layers formed from amorphous carbon or a plasma polymer, the layers having an inherently high hardness, and the outermost layer of the coating having hydrophobic properties. Furthermore, the hardness of an inner layer of a pair of layers is higher than the hardness of an outer layer. The coating is particularly suitable for the avoidance of drop impingement erosion caused by liquid drops, erosion caused by solid particles, such as ice, and contamination caused by deposition of dust particles and constituents which are dissolved in liquids. The coating prolongs the service life of the components and increases the power of the turbine.

7 Claims, No Drawings

COMPRESSOR FOR GAS TURBINES

This application is a Continuation of and claims priority under 35 U.S.C. § 120 to International application number PCT/IB02/04745, filed 12 Nov. 2002, and claims priority under 35 U.S.C. § 119 to Swiss application number 2001 2125/01, filed 19 Nov. 2001, the entireties of both of which are incorporated by reference herein.

BACKGROUND OF THE INVENTION

1. Field of the Invention

The invention relates to a compressor for gas turbines, and in particular to a coating for protecting against liquid drops and solid particles, which is applied to the surfaces of components in the inlet region of the compressor.

2. Brief Description of the Related Art

The components of compressors in turbines, such as for example power plants, aircraft and ship engines, are exposed to various particles during compressor operation, which may cause permanent damage to the surfaces of the components. These particles include liquid drops, inter alia water drops, and solid particles, such as for example dust particles, which enter the compressor together with the intake air. Mention should also be made of ice particles, which may form through desublimation as a result of the cooling of the air caused by the acceleration of the air. Of the components in the inlet region of the compressors, in particular the blading is affected by potential damage from these particles.

It is known that, during compressor operation, certain liquids are deliberately injected with the gas or air stream. For example, for cleaning purposes a mixture of water and a commercially available concentrate is injected into the compressor by means of one or more atomization nozzles, as described, for example, in EP 0 468 024.

During winter operation, the formation of ice at the entry to the compressor blading and the intake of ice particles (also known as ice ingestion) is extremely harmful to the integrity of the compressor. For this reason, glycol mixtures are injected to prevent the formation of ice at the compressor inlet.

Furthermore, water is introduced into the compressor by injection or atomization for the purpose of evaporative cooling of the intake gas or intake air. This evaporative cooling serves to increase the efficiency of the compressor and ultimately to increase the gas turbine power. A method of this type is disclosed, for example, by U.S. Pat. No. 5,463,873.

In the compressors of turbine jet engines, such as for example in aircraft and ships operated with gas turbines, the problem of damage to the compressor components arises, caused by rain, fog, mist, ice or salt water being sucked in.

If various liquids are injected or if liquid drops or solid particles are sucked in, the problem arises of drop impingement erosion or erosion caused by solid particles at the surfaces of the components, in particular of the blading and of the components in the inlet region of the compressor. Drop impingement erosion is caused, firstly, directly by the drops of liquid which are sprayed or sucked in on the surfaces of the components. At the start of the operating time of the spray nozzles for the injection of liquids, the drops which are sprayed in are initially small, i.e. with a diameter in the range from 10–20 micrometers. After a certain operating time, however, the spray nozzles become worn away such that the drops which they spray gradually reach a size of up to 100 micrometers in diameter. Since the mass and therefore the kinetic energy of the drops increases to the third power of the drop diameter, larger drops can cause far more erosion damage than small drops. Therefore, the drops which are sprayed by the spray nozzles may cause considerable drop impingement erosion.

Secondly, drop impingement erosion also occurs after the formation of continuous films of liquid if the components have been wetted by the injected liquid. The detachment of liquid from a surface allows secondary large drops to form, which can cause drop impingement erosion on components arranged downstream.

Finally, there is also the general problem of contamination caused by constituents which have been added to the injected water and gradually build up on the surfaces. Deposits of these constituents and of further foreign material may have an adverse effect on the service life of the components and also on the power of the gas turbine.

SUMMARY OF THE INVENTION

The present invention is based on the object of providing components of a compressor for a gas turbine, such as for example in a power plant or an aircraft or ship engine, whose surfaces withstand drop impingement erosion caused by liquid drops and erosion caused by solid particles, such as dust particles and ice. Furthermore, the surfaces of the components are to be such that they withstand the constituents and additives which are present in liquids and soiling deposits cannot be deposited thereon.

A compressor for a gas turbine according to the invention has components, such as for example the blading, which are provided at their surfaces with a coating which includes at least two layers of an amorphous carbon or a plasma polymer. The outermost layer of the coating in particular has hydrophobic properties. All layers or layer systems which have a low interfacial energy, provided that this is lower than the surface tension of water, are suitable for the hydrophobic layer.

Furthermore, these layers also have the inherently high surface hardness of amorphous carbon or a plasma polymer, such as for example from 500 to 3000 HV. The abovementioned amorphous carbon or a plasma polymer is particularly suitable for materials with hydrophobic properties and also hardnesses of this level.

The hydrophobic property of the outermost layer prevents the wetting of the surfaces. Liquid drops which impinge on the coating have very little interaction with the surface, since the interfacial energy of the latter is low. Consequently, the liquid drops do not adhere to the surfaces, but rather roll away over the surface, retaining their small size and without combining with other drops or even forming a continuous film of liquid. The formation of large drops of liquid as a result of a continuous film breaking off at an edge of one component is thereby prevented. The drops, which remain small, are therefore unable to cause any significant drop impingement erosion.

Hydrophobic layers, such as for example layers of amorphous carbon, furthermore also have dirt-repellant properties. On account of the fact that the liquid drops roll off immediately, chemical interaction between the liquid or constituents which are dissolved in the liquid and the surface is prevented. This therefore also prevents further foreign material from being deposited, which has beneficial effects on the power of the gas turbine and the service life of the coated components.

In a specific and preferred embodiment of the invention, the components of the compressor have a protective coating which includes a layer sequence with a pair of layers or a plurality of pairs of layers, the inner layer of a pair of layers having a higher hardness than the outer layer of the pair of layers, and the outer layer having a relatively low hardness. In particular, the inner layer of the pair of layers has a hardness of from 1500 to 3000 HV, and the outer layer has a hardness of from 500 HV to 1500 HV.

The alternating application of layers with a high hardness and in relative terms a lower hardness produces an interference effect, whereby the pressure or compression waves of different, ideally contrary, phases substantially cancel one another out, in the event of impingement of a liquid drop or of a solid particle. This destroys the pressure or compression waves and ultimately leads to the prevention of drop impingement erosion from liquid drops or erosion from solid particles such as dust or ice.

In a further embodiment of the invention, the individual layers of the layer sequence have thicknesses in the range from in each case 0.1 to 2 micrometers.

In a further particular embodiment of the invention, the thicknesses of the individual layers of the layer sequence are inversely proportional to their relative hardness. As an example, the outer layer may have a thickness of from 1.0 to 1.5 micrometers, and the inner layer may have a thickness of from 0.5 to 0.75 micrometer.

In a further preferred embodiment of the invention, the surfaces of the components of the compressor have a bonding layer to which a pair of layers or a plurality of pairs of layers are applied. An example of a suitable bonding layer is a harder layer which is applied to titanium and corresponds to the abovementioned inner layer.

DETAILED DESCRIPTION OF THE PREFERRED EMBODIMENTS

According to the invention, the hydrophobic coating contains amorphous carbon. In the text which follows, this term is to be understood as meaning hydrogen-containing carbon layers with a hydrogen content of from 10 to 50 atomic % and with a ratio of $sp^3$ to $sp^2$ bonds of between 0.1 and 0.9. In general, it is possible to use all amorphous or dense carbon layers which have been produced by means of carbon or hydrocarbon precursors, as well as plasma polymer layers, polymer-like or dense carbon and hydrocarbon layers, provided that they have the hydrophobic properties, and also the mechanical or chemical properties mentioned below, of amorphous carbon in order to produce individual layers or layer sequences. Amorphous carbon, also known as diamond-like carbon, is generally known for its extraordinary hardness, chemical stability and also for its elasticity. Furthermore, under certain conditions, amorphous carbon has a low surface energy compared to the surface tension of water, so that a hydrophobic or water-repellent property is produced. In this case, the hardness of amorphous carbon can be altered by varying the parameters used to produce a coating. A layer with, in relative terms, a lower hardness (within the hardness range of amorphous carbon) is only to be understood as being less hard than a hard layer. In particular, a less hard layer has a pronounced hydrophobic property.

The coating according to the invention can be realized using various generally known production processes, such as for example deposition by means of glow discharge in a plasma formed from hydrocarbon-containing precursors, ion beam coating and sputtering of carbon in hydrogen-containing working gas.

In these processes, the substrate is exposed to a flow of ions of several 100 eV. In the case of the glow discharge, the substrate is arranged in a reactor chamber in contact with a cathode, which is capacitively connected to a 13.56 MHz RF generator. The grounded walls of the plasma chamber form a large counterelectrode. Any hydrocarbon vapor or any hydrocarbon gas can be used as the first working gas for the coating in this arrangement. To achieve particular layer properties, for example different surface energies, hardnesses, optical properties, etc., different gases are added to the first working gas. For example, high or low surface energies are achieved by the addition of nitrogen, fluorine-containing or silicon-containing gases. The addition of nitrogen additionally leads to an increase in the hardness of the resulting layer. Furthermore, the resulting hardness of the layer can be controlled by varying the bias voltage across the electrodes between 100 and 1000 V, with a high bias voltage leading to a hard amorphous carbon layer and a low voltage leading to an amorphous carbon layer with, in relative terms, a lower hardness.

In the compressor according to the invention, all the components which come into contact with the intake air or with injected liquids are provided with the layer sequence. In particular, the components in the inlet region, such as for example the blading and the bearing for the adjustable inlet guide vane row are to be provided therewith.

The invention can be applied to compressors for gas turbines of power plants of any type and also of turbine jet engines and other components in aircraft and ships, such as for example the leading edge of the airfoils of aircraft.

The components of the compressor according to the invention consist of materials such as, for example, titanium, stainless steels, chromium steels, aluminum and carbide-forming agents. The described layer sequence with bonding layer is eminently suitable for application to such materials.

While the invention has been described in detail with reference to preferred embodiments thereof, it will be apparent to one skilled in the art that various changes can be made, and equivalents employed, without departing from the scope of the invention. Each of the aforementioned documents is incorporated by reference herein in its entirety.

What is claimed is:

1. A compressor for a gas turbine, comprising:

compressor components including surfaces, said surfaces including a coating to protect against erosion from liquid drops, solid particles, or both, the coating having at least two layers, which layers contain amorphous carbon or a plasma polymer, an outermost layer of the coating having hydrophobic properties.

2. The compressor as claimed in claim 1, wherein the coating has a pair of layers or a sequence of a plurality of pairs of layers, the hardness of an inner layer of a pair of layers being higher than the hardness of an outer layer of the same pair of layers.

3. The compressor as claimed in claim 2, wherein the inner layer of a pair of layers has a hardness in the range from 1500 to 3000 HV, and the outer layer of a pair of layers has a hardness in the range from 500 to 1500 HV.

4. The compressor as claimed in claim 2, wherein the thicknesses of the layers of the pairs of layers are inversely proportional to their hardnesses.

5. The compressor as claimed in claim 2, wherein the thicknesses of the inner and outer layers of the pairs of layers are in the range from 0.1 to 2 micrometers.

6. The compressor as claimed in claim 1, wherein said surfaces of the compressor components further comprise a bonding layer to which bonding layer said coating is applied.

7. The compressor as claimed in claim 1, wherein the compressor component surfaces comprise surfaces in an inlet region of the compressor, surfaces of blading of the compressor, surfaces of bearing locations of an adjustable inlet guide vane row, or combinations thereof; and wherein said coating is applied to said compressor component surfaces.

* * * * *